United States Patent [19]

Miyasaka et al.

[11] 4,087,957

[45] May 9, 1978

[54] MOVEMENT CONSTRUCTION FOR SMALL SIZE ANALOG QUARTZ TIMEPIECE

[75] Inventors: Kenzi Miyasaka; Mitsuhiro Murata, both of Tokyo; Hiroyuki Uematsu, Kunitachi, all of Japan

[73] Assignee: Citizen Watch Company Limited, Tokyo, Japan

[21] Appl. No.: 752,362

[22] Filed: Dec. 20, 1976

[30] Foreign Application Priority Data

| | | |
|---|---|---|
| Dec. 25, 1975 | Japan | 50-159483 |
| Feb. 24, 1976 | Japan | 51-19083 |
| Apr. 13, 1976 | Japan | 51-45919[U] |
| Aug. 12, 1976 | Japan | 51-96402 |

[51] Int. Cl.[2] ..... G04C 3/00; G04B 29/02; G04B 33/00

[52] U.S. Cl. ..... 58/23 R; 58/23 BA; 58/23 D; 58/52 R; 58/59; 58/104

[58] Field of Search ..... 58/23 A, 23 BA, 23 D, 58/52 R, 55, 59, 104, 23 R

[56] References Cited

U.S. PATENT DOCUMENTS

| | | | |
|---|---|---|---|
| 3,628,324 | 12/1971 | Chopard et al. | 58/23 D |
| 3,842,585 | 10/1974 | Lupoli | 58/55 |
| 3,902,312 | 9/1975 | Yamazaki | 58/23 D |
| 3,958,408 | 5/1976 | Nagasawa | 58/55 |

*Primary Examiner*—Edith S. Jackmon
*Attorney, Agent, or Firm*—Frank J. Jordan

[57] ABSTRACT

A movement construction for a small size analog quartz timepiece having a battery, a quartz crystal oscillator, an integrated circuit chip, an electro-mechanical transducer including a driving coil, stators and a rotor, and a wheel train driven by the electro-mechanical transducer to actuate a time-indicating mechanism. In one preferred embodiment, the driving coil, stators and battery are arranged in a predetermined order along the longitudinal axis of the movement construction and the integrated circuit chip is disposed to be in vertical alignment with the stators. In another preferred embodiment, the driving coil, stators and battery are arranged in spaces different from each other in a horizontal plane.

17 Claims, 9 Drawing Figures

MOVEMENT CONSTRUCTION FOR SMALL SIZE ANALOG QUARTZ TIMEPIECE

This invention relates to compact electronic timepieces equipped with a time-indicating mechanism driven by a stepping motor and, more particularly, to a movement construction specifically suited for such timepieces.

In recent years analog quartz timepieces have become quite popular. These timepieces employ a miniature battery as a power source, a quartz oscillator and associated electronic circuitry to produce a time unit signal which rotates a stepping motor, and time is displayed by means of a time-indicating mechanism including an hours and minutes hand. Owing to the large size of the elements which constitute timepieces of this type, namely the electronic circuitry incorporating the quartz oscillator, the stepping motor, the wheel trains and the battery, it has been extremely difficult according to conventional arrangements to produce compact timepieces; in fact, extremely small bracelet-type analog quartz watches for women have not been feasible. The advent of a movement for such a bracelet-type watch for women, especially one which is sub-compact and allows for freedom of case design, has long been awaited.

It is, therefore, an object of the present invention to provide a movement construction suited for use in an analog quartz timepiece.

It is another object of the present invention to provide a miniaturized movement construction for use in a bracelet-type analog quartz watch for women.

It is another object of the present invention to provide a miniaturized watch movement construction which makes the most efficient utilization of available space.

It is still another object of the present invention to provide a miniaturized watch movement construction which is easy to assemble and low in manufacturing cost.

These and other objects, features and advantages of the present invention will become more apparent from the following description when taken in conjunction with the accompanying drawings, in which.

Figure 1:
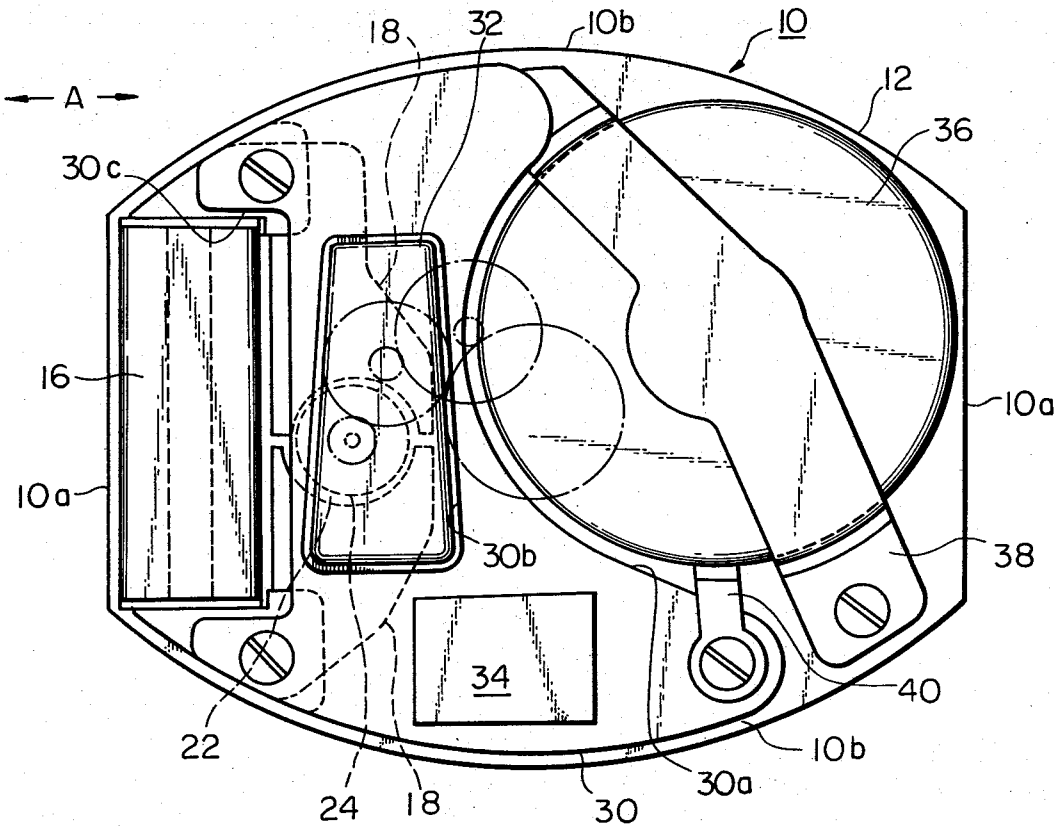
FIG. 1 is a plan view of a preferred embodiment of a watch movement construction according to the present invention.
Figure 2:
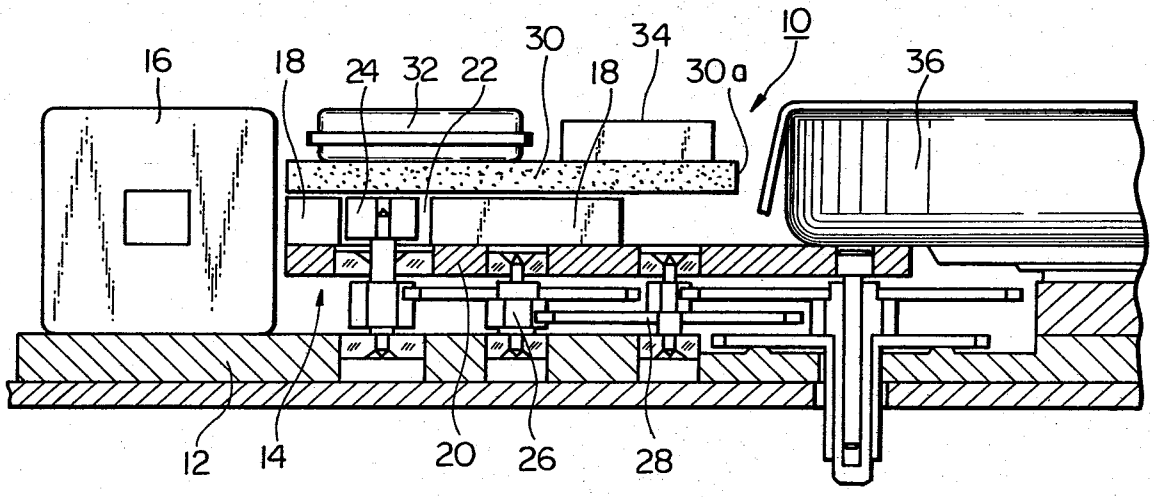
FIG. 2 is a cross sectional view of the movement construction shown in FIG. 1.

Referring now to FIGS. 1 and 2, there is shown a preferred embodiment of a miniaturized analog quartz watch movement construction according to the present invention. The movement 10 comprises a flat base plate 12 formed in a barrel-shape and has the same shape as the base plate 12. Thus, the movement 10 has a pair of flat walls 10*a* and a pair of curved walls 10*b* substantially symmetric with respect to each other. A driving coil 16 forming part of an electro-mechanical transducer, i.e., a stepping motor 14 is mounted on the base plate 12 in parallel to the flat wall 10*a*. A pair of stators 18 which also forms part of the electro-mechanical transducer 14 are mounted on a wheel support plate 20 adjacent to the driving coil 16 and have a rounded space 22 in which a rotor 24 is disposed and rotatably supported by the support plate 20. As shown in FIG. 1, the stator 18 are substantially parallel to the driving coil 16. The support plate 20 is spaced from the base plate 12 in a parallel relationship and rotatably supports a wheel train composed of toothed wheels 26 and 28, etc., which are driven by the rotor 24 to actuate a time-indicating mechanism such as minutes and hours hands (not shown). An insulating circuit substrate 30 is disposed over the stators 18 in parallel to the support plate 20 and has first, second and third cutouts 30*a*, 30*b* and 30*c* formed in order along the longitudinal axis of the movement 10 to provide spaces independent from each other in a horizontal plane to accommodate a battery 36, a quartz crystal oscillator 32 and the driving coil 16, respectively. A quartz crystal oscillator 32 forming part of an oscillator circuit (not shown) is mounted on an upper surface of the substrate 30 such that the longitudinal axis of the quartz crystal oscillator is substantially parallel to the axis of the driving coil 16. An integrated circuit chip 34 is also mounted on the upper surface of the substrate 30 adjacent to the curved wall 10*b* of the movement 10. The integrated circuit chip 34 is electrically connected to the quartz crystal oscillator 32 and provides a drive signal to energize the driving coil 16 to rotate the rotor 24 by which the time-indicating mechanism is actuated to indicate time information. The battery 36 is disposed on the support plate 20 and held in place by a positive terminal 38 at an area adjacent to the stators 18 and the quartz crystal oscillator 32. In this illustrated embodiment, since the movement 10 is extremely miniaturized, the flat area occupied by the battery 36 covers the center of the movement 10 and extends toward the corner between walls 10*a* and 10*b*. As previously described, since the quartz crystal oscillator 32 is disposed adjacent to and substantially parallel to the driving coil 16, the flat space of the movement 10 can be efficiently utilized and the quartz crystal oscillator 32 is prevented from being superposed on the battery 36. Thus, the thickness of the movement 10 can be reduced.

It will now be understood that in the illustrated embodiment of FIGS. 1 and 2 the driving coil 16, the stators 18 and the battery 36 are arranged in order along a longitudinal axis A of the movement 10 while the quartz crystal oscillator 32 is vertically aligned with the stators 18 whereby the space in the movement 10 can be efficiently utilized to the maximum extent and it is possible to provide an extremely miniaturized analog quartz watch such as a bracelet-type watch for women.

While, in the illustrated embodiment of FIGS. 1 and 2, the quartz crystal oscillator has been shown and described as being placed on the substrate 30 disposed over the stators 18, the quartz crystal oscillator may be disposed over the stators and the circuit substrate may be disposed over the quartz crystal oscillator to support the same.

Figure 3:
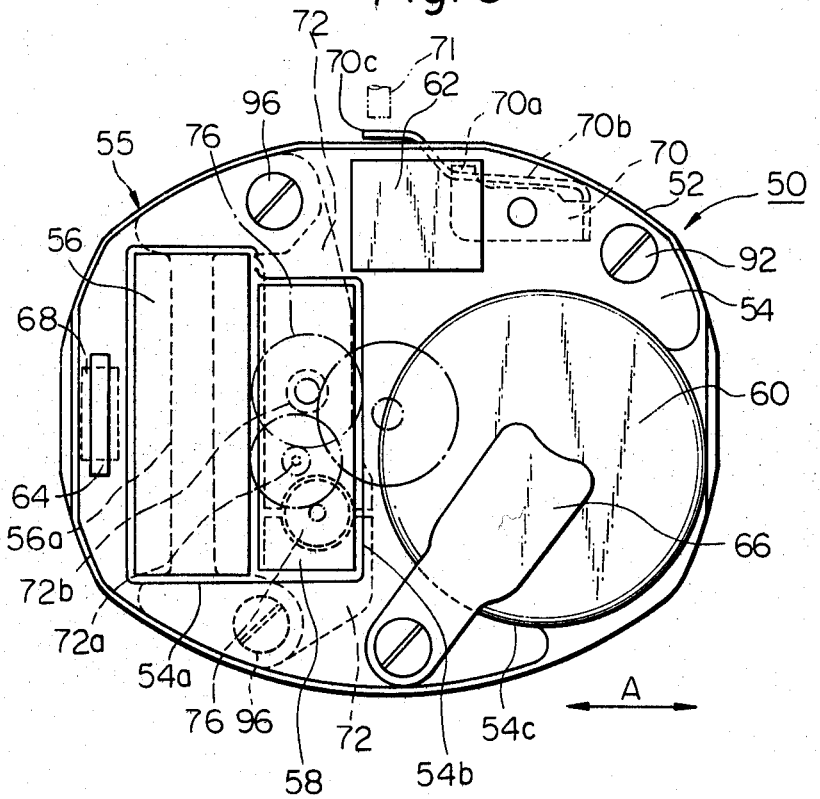
FIG. 3 is a plan view of another preferred embodiment of a watch movement construction according to the present invention.

FIG. 3 shows another preferred embodiment of a watch movement construction according to the present invention. In this illustrated embodiment, the movement 50 is substantially barrel-shaped and has a base plate 52 on which an insulating circuit substrate 54 is mounted in a spaced relationship with respect thereto. The substrate 54 has first, second and third cutouts 54*a*, 54*b* and 54*c* formed in order along the longitudinal axis A, to accommodate a driving coil 56 of a stepping motor 55, a quartz crystal oscillator 58 forming part of an oscillator circuit (not shown), and a battery 60 in the same order. The substrate 54 supports at its upper surface an integrated circuit chip 62 adapted to provide a drive signal to energize the stepping motor 55 to actuate a time-indicating mechanism, a capacitor 64 for the oscillator circuit, and a positive terminal 66 serving as a battery retainer. The quartz crystal oscillator 58, a trimming capacitor 68 adapted to adjust the oscillating frequency of the quartz crystal oscillator 58, and a time correction switch 70 are supported at the bottom surface of the substrate 54. The stepping motor 55 includes, in addition to the driving coil 56, a pair of stators 72 and a rotor 74 associated with the stators 72. The rotor 74 drives a wheel train 76 connected to the time-indicating mechanism, the wheel train being arranged between the driving coil 56 and the battery 60 in the horizontal plane.

The correction switch 70 is composed of a stop 70*a*, and a contact spring 70*b* which is held in bent condition by the stop 70*a* such that an end 70*c* remains in an area adjacent to or closest to the outer periphery of the movement 50. With this arrangement, the end 70*c* of the contact spring 70*b* is not brought into interference with a push-button 71 mounted in a watch case when the movement 50 is assembled to the watch case, whereas when the push-button 71 is depressed the switch 70 is closed. When the push-button 78 is released, the push-button 78 is returned to its original position by the action of the contact spring 70*b* of the correction switch 70. Since this correction switch 70 is composed of a minimum number of components and occupies a minimum space, the switch 70 is specifically suited for use in a miniaturized movement. As shown in FIG. 3, the correction switch 70 can be readily mounted in a space provided by positioning the battery 60 closest to the outer periphery of the movement 50.

Figure 4:
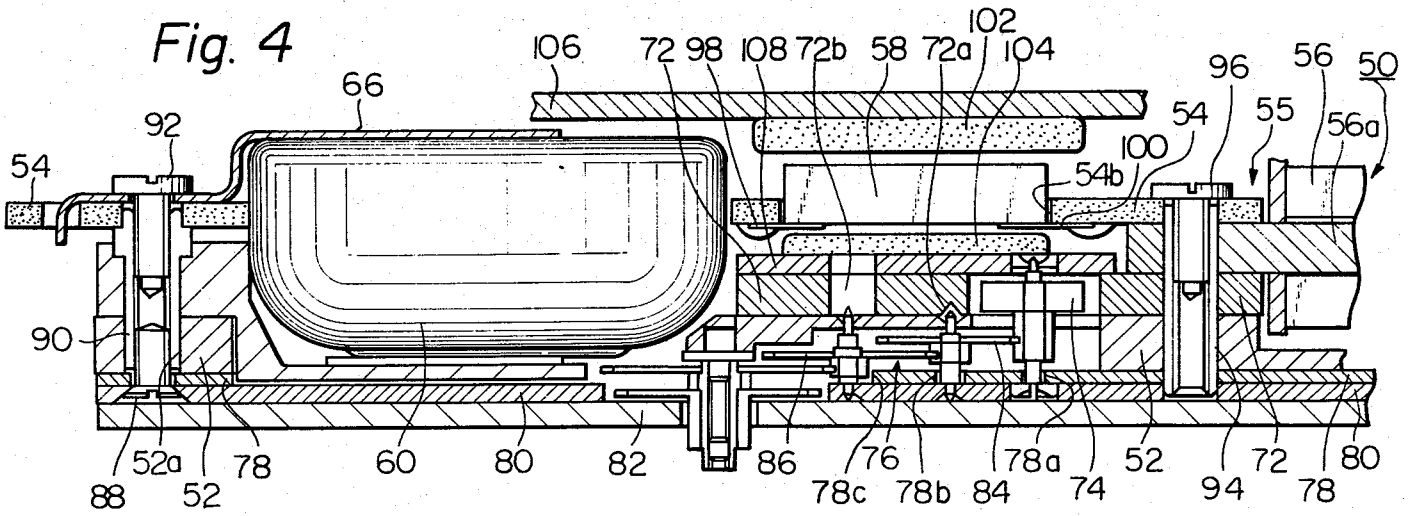
FIG. 4 is a cross sectional view of the movement construction shown in FIG. 3.

FIG. 4 is a cross section of the watch movement construction shown in FIG. 3. As shown in FIG. 4, the movement 50 has a magnet shielding plate 78 interposed between the base plate 52 and a wheel support plate 80 to which a dial 82 is fixed. The wheel support plate 80 is formed with a plurality of bores in which an end of a shaft of the rotor 74 and ends of shafts of toothed wheels 84 and 86 of the wheel train 76 are rotatably supported. The magnet shielding plate 78 has a plurality of large diameter guide bores 78*a*, 78*b* and 78*c* concentric with the bores of the wheel support plate 80 so that the support plate 80 can be easily assembled to the movement 50 because of plays provided by the guide bores 78*a*, 78*b* and 78*c*. The shielding plate 78 and the support plate 80 are fixedly connected to the base plate 52 by a screw 88 screwed into a connecting tube 90 tightly fitted into a bore 52*a* of the base plate 52. The tube 90 serves as a positioning means by which the substrate 54 is maintained in a fixed position. Indicated as 92 is a screw which fixedly connects the substrate 54 and the positive terminal 66 to the tube 90. Connecting tubes 94 are also tightly fitted into bores of the substrate 54, a core 56*a* of the driving coil 56, the stators 72, the base plate 52, the shielding plate 78 and the support plate 80, which are consequently fixed in place. Screws 96 are threaded into the connecting tubes 94 to fixedly connect the substrate 54, the core 56*a*, the stators 72 to the base plate 52.

The quartz crystal oscillator 58 disposed in the cutout 54*b* is resiliently supported by lead plates 98 and 100 secured to the bottom wall of the substrate 54 by soldering such that it is displaceable in a vertical direction to alleviate impact shocks to be applied to the quartz crystal oscillator 58. Thus, the lead plates 98 and 100 serves as shock absorbing means. Adjacent to both sides of the quartz crystal oscillator 58, shock absorbing rubber plates 102 and 104 are provided as shock absorbing members. The rubber plates 102 and 104 are attached to the inner wall of a back cover 106, and an upper wall of a bearing plate 108 secured to the upper surface of the stator 72, respectively. Thus, when the movement 50 is subjected to the great impact shocks, the quartz crystal oscillator 58 is prevented from being damaged or shifted in output frequency.

In FIG. 4, the stator 72 is formed at its bottom wall with an indent 72*a* concentric to the axis of the toothed wheel 84, and a vertical bore 72*b* to accommodate the upper end of the shaft of the toothed wheel 86, reducing the thickness of the movement 50.

Figure 5:
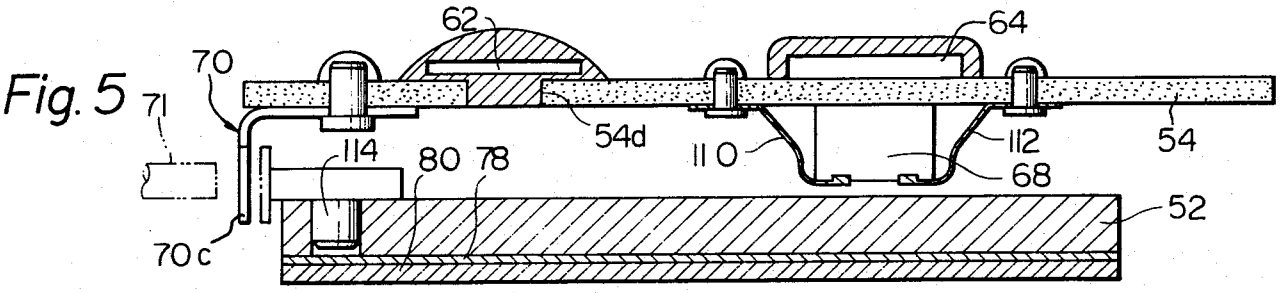
FIG. 5 is similar to FIG. 4 but shows in enlarged scale an essential part of the movement construction shown in FIG. 3.

FIG. 5 is a fragmentary enlarged cross sectional view of the circuit substrate 54 shown in FIG. 3. As shown in FIG. 5, the trimming capacitor 68 is detachably supported on the bottom wall of the substrate 54 by a pair of springs 110 and 112 secured thereto. The integrated circuit chip 62 is bonded to the upper wall of the substrate 54 and sealed thereto by some suitable sealing material such as a resin by which a bore 54*d* of the substrate 54 is also sealed. Consequently, the active surface of the integrated circuit chip 62 is effectively sealed. Indicated as 114 is a rivet or contact pin which serves as a stationary contact for the switch 70 and is connected to the base plate 52. When the push-button 71 is depressed, the end 70*c* of the contact spring is brought into contact with the stationary contact 114, to cause a timepiece circuit incorporated in the integrated circuit chip 62 to produce a high frequency driving pulses. These driving pulses are applied to the stepping motor 55, which is consequently rotated at a rapid speed to perform time correction.

It will now be appreciated that in the illustrated embodiment of FIGS. 3 to 5 a battery is disposed in a half area of the watch movement in another half area of which a quartz crystal oscillator and a stepping motor are disposed and other electronic components such as an integrated circuit chip and capacitors are disposed adjacent to the quartz crystal oscillator or the stepping motor whereby the watch movement can be extremely miniaturized. Since, further, a conventional hand setting mechanism including a time setting lever and a time setting wheel, etc. which rquire a larger and complicated space is replaced by a time-correction switch of a simple construction, the space occupied by the switch can be minimized and the watch movement can be easily assembled. In addition, the connecting tubes are designed to serve as positioning means or a guide and, therefore, the number of connecting pins or tubes can be reduced to a minimum value. Moreover, since the magnet shielding plate has bores serving as guides, the shafts of the toothed wheels are maintained in a substantially vertical direction during assembly of the movement so that the assembly can be easily performed.

According to the movement construction mentioned above, since the centers of the driving coil 56, the quartz crystal oscillator 58 and the battery 60 are arranged to be as close as possible to the longitudinal axis of the movement, the back cover 106 may be formed with a slanted wall so that the watch seems to have reduced thickness.

Figure 6:
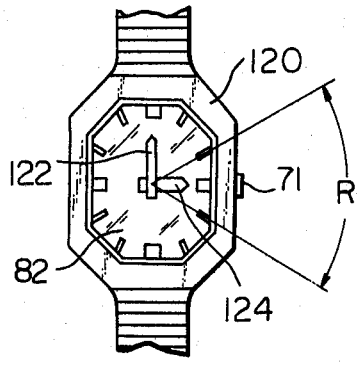
FIG. 6 is a schematic view of the external appearance of an example of a wristwatch incorporating the movement construction shown in FIGS. 3 to 5.

FIG. 6 shows the external appearance of an example of a bracelet-type, two hand analog quartz watch incorporating the movement shown in FIGS. 3 to 5 with like parts bearing like reference numerals as those used therein. Reference numeral 120 designates a watch case, 122 a minutes hand, and 124 an hours hand. In this illustrated example, the push-button 71 is mounted at the side of the watch case 124 at a position corresponding to 3:00 o'clock on the dial.

Figure 7:
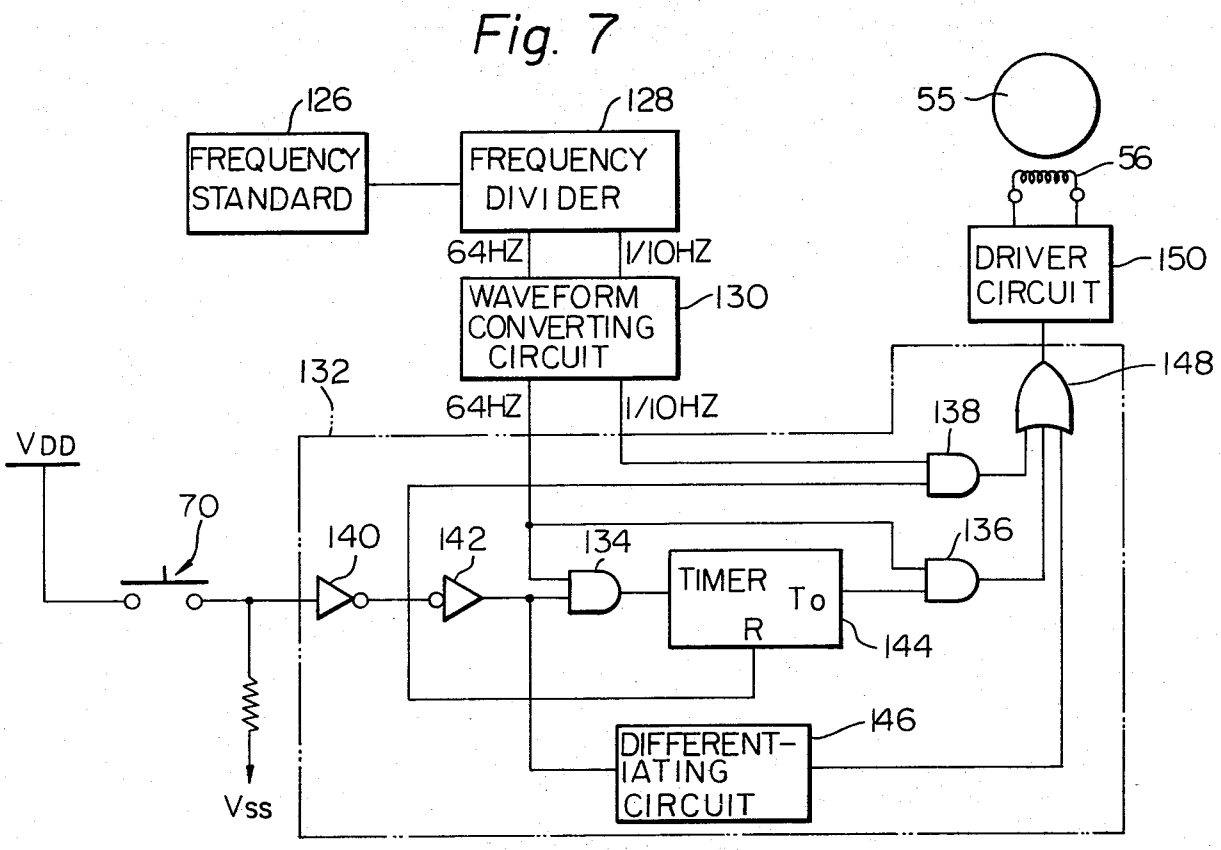
FIG. 7 is a block diagram of the electric circuitry for the integrated circuit shown in FIGS. 3 to 5.

FIG. 7 shows a block diagram of the electric circuitry for the watch shown in FIG. 6. Reference numeral 126 denotes a frequency standard controlled by the quartz crystal oscillator 58 (see FIGS. 3 and 4) to provide a relatively high frequency signal of 32,768 Hz. This high frequency signal is applied to a frequency divider which produces a 1/10 Hz reference signal and a 64 Hz correction signal. Each of these signals after being converted to a suitable pulse width by a waveform converting circuit 130 are then applied as inputs to a correction control circuit 132. The 64 Hz correction signal is applied to one input terminal of AND gates 134 and 136 of the control circuit 132 and the 1/10 Hz reference signal is applied to one input terminal of an AND gate 138. In addition to AND gates 134, 136 and 138, the correction control circuit 132 also includes inverters 140 and 142, a timer 144, a differentiating circuit 146 and an OR gate 148. The switch 70 is opened or closed in response to the button 71 shown in FIG. 6 and has one terminal connected to the input side of the inverter 140 the output side of which is connected to the input side of the inverter 142, reset terminal R of the timer 144 and the remaining input terminal of the AND gate 138. The output side of the inverter 142 is connected to the remaining input terminal of the AND gate 134 and the input side of the differentiating circuit 146. The output signal from the AND gate 134 is applied to the input side of the timer 144 the output side of which is in turn connected to the remaining input side of the AND gate 136. The output sides of the AND gates 136 and 138 and the differentiating circuit 146 are all connected to the input side of the OR gate 148 which supplies output signals to the input side of a driver circuit 150.

When the button 71 is in the normally non-depressed state, the switch 70 is open, the input of the inverter 140 is at a low logic level, the output of the inverter 140 is at a high logic level and the output of the inverter 142 is at a low level. Accordingly, the outputs of the AND gate 134, the timer 144, AND gate 136 and the differentiating circuit 146 are all held at a low logic level and only the 1/10 Hz reference signal is applied to the input side of the driver circuit 150 via the AND gate 138 and the OR gate 148. The stepping motor 55 is consequently driven step-wise once every 10 seconds with the minutes hand 122 and hours hand 124 thus advancing at 10-second intervals.

Depressing the button 71 for a short period of time causes the switch 70 to close instantaneously for an equivalent period to thereby instantaneously reverse the aforementioned logical states before they return to their normal logic levels. That is, the input of the inverter 140 assumes a high logic level, the output of the inverter 140 a low logic level and the output of the inverter 142 a high logic level momentarily before returning to their original states. As a consequence the differentiating circuit 146 produces a single correction pulse which is applied across the OR gate 148 as an input signal to the driver circuit 150. This causes the motor 55 to be driven forward one step so that the minutes hand 122 and the hours hand 124 also advance one time.

If the button 71 is kept depressed beyond a prescribed period of time, the switch 70 is closed for an equivalent period and the outputs of the inverter 140 and inverter 142 all maintain their newly induced states, i.e., low and high logic levels, respectively. This renders the AND gates 138 OFF and the AND gate 134 ON so that the 64 Hz correction signal is applied as an input to the timer 144. At the same time that the 64 Hz correction signals as counted by the timer 144 attain a prescribed value, output terminal To of the timer 144 attains a high logic level which causes the AND 136 to open. The 64 Hz correction signal is thus passed by the AND gate 136 and the OR gate 148 and applied as an input to the driver circuit 150. Accordingly, the motor 55 is driven by 64 Hz driving pulses which causes the minutes hand 122 and the hours hand 124 to advance at a rapid rate. By releasing the button 71 and thereby opening the switch 70, the outputs of the inverters 140 and 142 attain respective high and low logic levels, the timer 144 is reset, the AND gates 134 and 136 are inhibited and the AND gate 138 is open. In other words, the watch has returned to its normal operating state.

Thus in accordance with the time correction feature of the watch as herein embodied, a time correction is performed through the following procedure. The button 71 is depressed and held in the depressed state beyond a certain prescribed period causing the minutes hand 122 and the hours hand 124 to be advanced in rapid fashion by means of the time-indicating mechanism. Shortly before the hands of the timepiece have attained the desired correct setting, the button 71 is released and rapid advance of the hands ceases. Next, momentarily depressing the button 71 and releasing it in a repetitive manner for a required number of times advances the time-indicating mechanism one step at a time enabling the displayed time to be accurately set without difficulty.

In the present embodiment the direction of hand movement for cases in which the button 71 is depressed momentarily or for cases in which it is depressed for a prolonged period has been chosen to coincide with the direction of hand advance during normal timepiece operation; however, it is equally permissible to adapt the invention such that the hands move for either the 64 Hz or 2 Hz signal in a direction opposite to the direction of normal hand advance.

Turning now to FIGS. 5 and 6, the contact pin 114 forming one terminal of the switch 70 is disposed in the vicinity of the right-hand side of the movement at a position corresponding to the 3:00 o'clock. Extending opposite pin 114 is the contact spring **70*b* which forms the other terminal of the switch 70. Disposing the battery 60 off-center at the left-hand side of the movement, as is the case in the present embodiment, creates a space for installation of the fixed terminal of the contact spring 70*b* (see FIG. 3). In accordance with this construction it is possible to adopt the switching mechanism while utilizing only a very limited space even in a compact, barrel-shaped movement. It also goes without saying that the order of arrangement of the driving coil 56, the stators 72 and the battery 60** as herein described may be reversed while still leaving enough space for installation of the fixed portion of the contact spring.

According to this structure it is therefore possible to readily install in the vicinity of the right-hand side of the movement a switch including a contact spring and contact pin. In other words, it is possible to improve upon the efficient use of space in the movement as a whole by applying the present arrangement for the switching mechanism.

In the timepiece as shown in FIG. 6, the button 71 is located at the side of the case 120 at a position corresponding to 3:00 o'clock on the dial. Adopting such an arrangement for the time correction button makes it appear at a glance as if an external control has been eliminated and this presents an extremely novel design for an analog display type timepiece. Moreover, by adopting a recessed type time correction button which does not greatly protrude from the side of the case 120 it is possible to prevent random operation of the wristwatch as well as provide an extremely simple and attractive design for a bracelet watch or similar timepiece. Adopting a button-type switch as the external control member for effecting the time adjustment allows for switch operation merely by depressing the button. Consequently, the external control member may be installed at the right-hand side of the timepiece anywhere between the positions corresponding to 2:00 and 4:00 o'clock on the clock dial without causing any inconvenience to the timepiece user when making a time correction.

Although the switching mechanism included within the movement must necessarily be installed in the vicinity of the corresponding external control member, disposing the switching mechanism comprising the contact pin and contact spring at the right-hand side of the movement is an extremely effective arrangement which makes the most efficient use of space.

The gist of the present invention as herein described therefore resides in installing an external control switch for time correction at the side of a case for an analog crystal timepiece anywhere between the positions corresponding to 2:00 and 4:00 o'clock on the timepiece dial. This removes the necessity of installing a hand-setting mechanism, time setting wheels and a slip mechanism which were required components in conventional timepieces and thus makes it possible to design even smaller timepieces with inexpensive movements which are simple in structure and therefore more reliable. It is also now possible to provide even analog crystal timepieces which are novel in appearance and both simple and attractive in design. The present invention also improves upon the efficient use of space especially in the arrangement of a timepiece movement for such non-circular movements as those which possess barrel-shaped, eliptical or elongated configurations. It is additionally permissible to provide two buttons as external control members, one located in the vicinity of 2:00 o'clock on the dial and the other in the vicinity of 4:00 o'clock. Further, it is not absolutely necessary to install the external control member at the side of the timepiece case; the control member may equally well be disposed at the front of the timepiece along the side of the case anywhere between the positions corresponding to 2:00 and 4:00 o'clock on the dial or at the equivalent location on the back cover of the timepiece.

Figure 8:
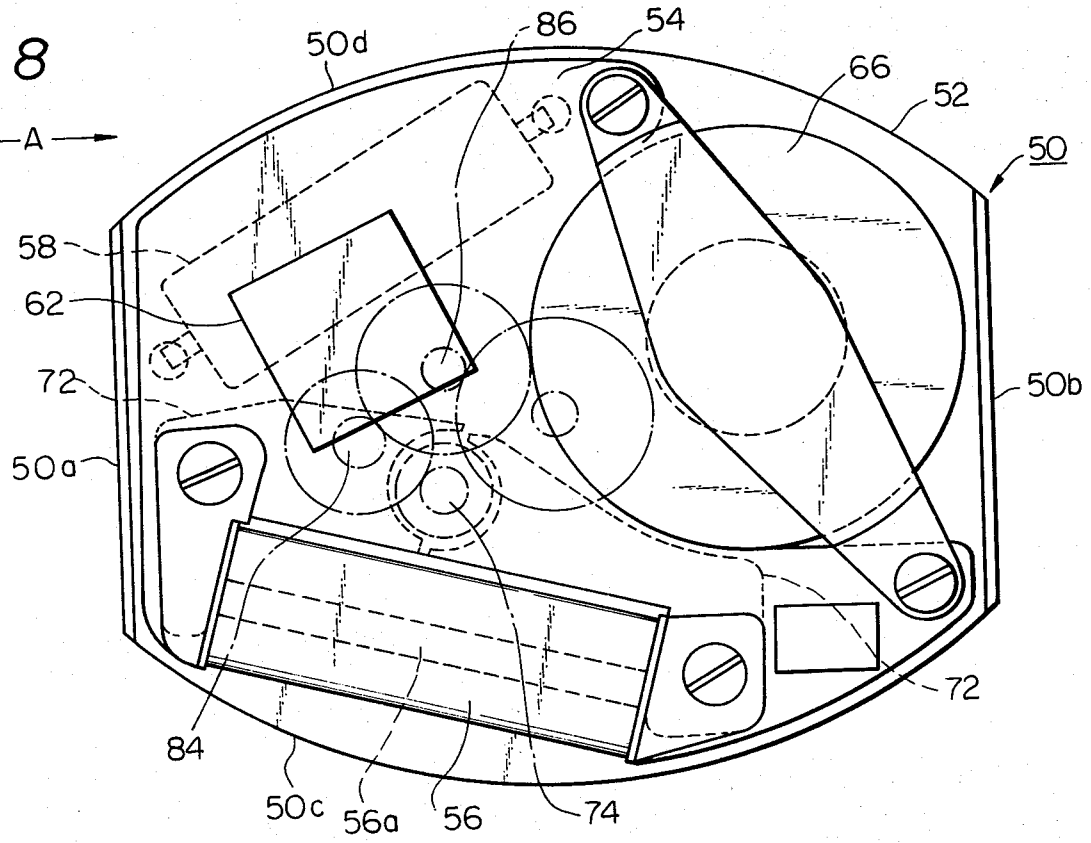
FIG. 8 is a plan view of a modified form of the watch movement construction shown in FIGS. 3 to 5.
Figure 9:
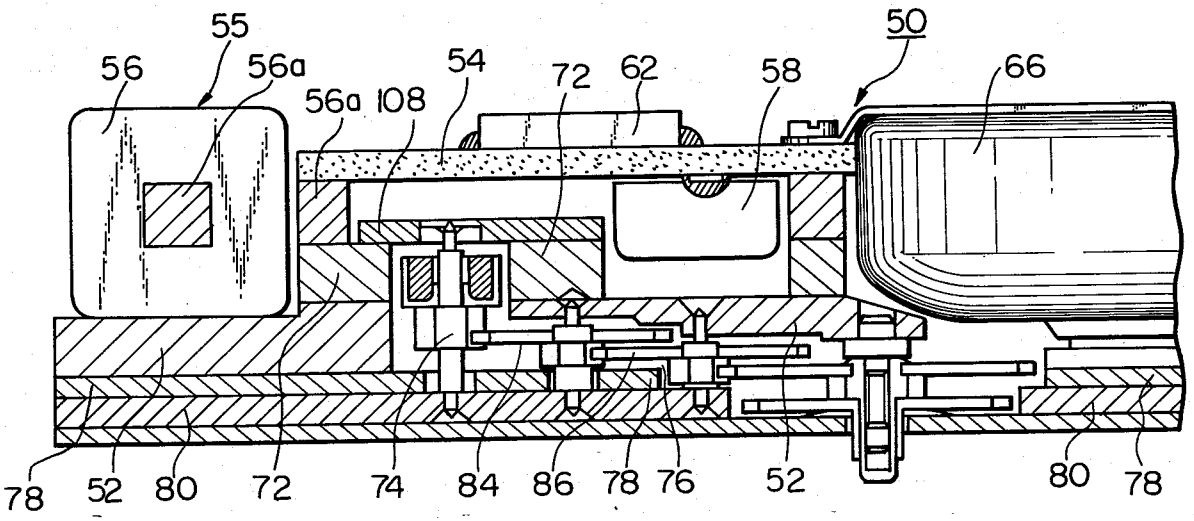
FIG. 9 is a cross sectional view of the movement construction shown in FIG. 8.

A modified form of the watch movement construction is illustrated in FIGS. 8 and 9, in which like or corresponding component parts are designated by the same reference numerals as those used in FIGS. 3 to 5. In this modification, the driving coil 56, the quartz crystal oscillator 58 and the battery 66 are disposed in spaces different or independent from each other in a horizontal plane. More specifically, the driving coil 56 is disposed on the base plate 52 such that one end of the driving coil 56 is located near the flat side **50*a* and another end thereof located at the curved side 50*c* of the movement 50. The stators 72 forming part of the stepping motor 55 is mounted on the wheel support plate 72 adjacent to the driving coil 56 and connected to the core 56*a* of the driving coil 56. Below the stators 72, the wheel train 76 is provided between the base plate 52 and the wheel support plate 80, between which the magnet shielding plate 78 is also interposed. The circuit substrate 54 is mounted on the core 56*a* of the driving coil 56 and supports thereon the integrated circuit chip 62**.

In the illustrated embodiment of FIG. 4, the quartz crystal oscillator 58 is resiliently supported by the lead plates 98 and 100 mounted at the bottom wall of the substrate 54. In the modification shown in FIGS. 8 and 9, on the contrary, the quartz crystal oscillator 58 is directly supported by the bottom wall of the substrate 54 such that its one end is located at the flat side **50*a* and its another end is located near the curved side 50*d* as shown in FIG. 8. In this case, a portion of the integrated circuit chip 62 is disposed in the same horizontal space as that of at least one of the horizontal spaces in which the quartz crystal oscillator 58 and the stators 72 are placed. The battery 66 is disposed in the flat space different from those in which the driving coil 56 and the stators 72 are disposed. The horizontal space in which the battery 66 is located covers the center of the movement 50 and extends toward the corner between the flat side 50*b* and the curved side 50*d***.

With this construction, the driving coil 56, the quartz crystal oscillator 58 and the battery 66 are arranged in flat spaces different or independent from each other, respectively. Each of these flat spaces extends toward outer periphery of the movement and the portion of the integrated circuit chip 62 is arranged to be vertically aligned with at least one of the quartz crystal oscillator 58 and the stators 72 whereby the efficient use of space can be obtained to provide a miniaturized movement construction.

The aforementioned specific arrangement of the quartz crystal oscillator 58 and the driving coil 56 is specifically advantageous for such non-circular movements as those which posses barrel-shaped, eliptical or elongated configurations, and the battery 66 can be readily accommodated in the movement 50 even in a case where the movement 50 is manufactured to a small size. The other structure of the modification shown in FIGS. 8 and 9 is similar to that shown in FIGS. 3 to 5 and, therefore, a detailed description of the same is omitted for the sake of simplicity of description.

It will now be appreciated from the foregoing description that in accordance with the present invention a quartz crystal oscillator, a driving coil of a stepping motor and a battery are arranged in a horizontal plane in a predetermined order whereby a watch movement can be miniaturized.

While the present invention has been shown and described with reference to particular embodiments by way of example, it should be noted that various other changes or modifications may be made without departing from the scope of the present invention.

What is claimed is:

1. A movement construction for a small size analog quartz timepiece having a battery, a quartz crystal oscillator, an integrated circuit chip connected to said quartz crystal oscillator to provide a drive signal, an electromechanical transducer including a driving coil, stators and a rotor adapted to be driven in response to said drive signal, and a wheel train driven by said electromechanical transducer to actuate a time-indicating mechanism, comprising a base plate, a wheel support plate mounted on said base plate in a spaced relationship with respect thereto to accommodate therebetween said wheel train, and a circuit substrate spaced from said wheel support plate and having first and second cutouts formed in predetermined positions to provide spaces independent from each other in a horizontal plane to accommodate said driving coil and said battery, respectively.

2. A movement construction according to claim 1, in which said movement construction has a non-circular configuration.

3. A movement construction according to claim 2, in which said movement construction is barrel-shaped.

4. A movement construction according to claim 3, in which said movement construction has a longitudinal axis, and said first and second cutouts are formed along the longitudinal axis of said movement construction.

5. A movement construction according to claim 4, in which said circuit substrate also has a third cutout formed between said first and second cutouts to accommodate said quartz crystal oscillator.

6. A movement construction according to claim 5, in which said stators are mounted between said base plate and said wheel support plate in a horizontal plane between said driving coil and said battery.

7. A movement construction according to claim 6, in which said quartz crystal oscillator is supported by said circuit substrate in substantially vertical alignment with said stators.

8. A movement construction according to claim 3, in which said integrated circuit chip is mounted on said circuit substrate.

9. A movement construction according to claim 7, in which said timepiece also has first and second capacitors mounted on said circuit substrate at upper and bottom sides thereof, respectively.

10. A movement construction according to claim 7, in which said second cutout is formed at a position close to the outer periphery of said movement construction such that an outer periphery of said battery is close to the outer periphery of said movement construction to provide a space for accommodating a time-correction switch along the outer periphery of said movement construction.

11. A movement construction according to claim 10, in which said integrated circuit chip includes means for generating correction signals to perform time correction when said switch is actuated.

12. A movement construction according to claim 5, in which said battery is disposed in a half area of said movement construction and said driving coil and said quartz crystal oscillator are disposed in another half area of said movement construction.

13. A movement construction according to claim 10, in which said timepiece also has a case to accommodate said movement construction, and a push-button mounted at a side of said case to actuate said time correction switch.

14. A movement construction according to claim 8, in which said spaces provided by said first and second cutouts extend toward the outer periphery of said movement construction.

15. A movement construction according to claim 14, in which said driving coil has its one end close to a flat side of said movement construction and its another end close to a first curved side thereof.

16. A movement construction according to claim 15, in which said quartz crystal oscillator is secured to a bottom wall of said circuit substrate at such a position that one end of said quartz crystal oscillator is close to said flat side and another end thereof is close to a second curved side of said movement construction.

17. A movement construction according to claim 16, in which a portion of said integrated circuit chip is vertically aligned with said quartz crystal oscillator.

* * * * *